US011798455B1

(12) United States Patent
He

(10) Patent No.: US 11,798,455 B1
(45) Date of Patent: Oct. 24, 2023

(54) DISPLAY DEVICE, DISPLAY CONTROL METHOD, AND ELECTRONIC EQUIPMENT

(71) Applicant: TCL CHINA STAR OPTOELECTRONICS TECHNOLOGY CO., LTD., Shenzhen (CN)

(72) Inventor: Guanxian He, Shenzhen (CN)

( * ) Notice: Subject to any disclaimer, the term of this patent is extended or adjusted under 35 U.S.C. 154(b) by 0 days.

(21) Appl. No.: 17/852,448

(22) Filed: Jun. 29, 2022

(30) Foreign Application Priority Data

Jun. 15, 2022 (CN) ..... 202210678068.X

(51) Int. Cl.
*G09G 3/20* (2006.01)

(52) U.S. Cl.
CPC ..... *G09G 3/2011* (2013.01); *G09G 3/2074* (2013.01); *G09G 2300/0426* (2013.01); *G09G 2310/027* (2013.01); *G09G 2310/08* (2013.01); *G09G 2320/0209* (2013.01)

(58) Field of Classification Search
None
See application file for complete search history.

(56) References Cited

U.S. PATENT DOCUMENTS

2014/0240246 A1 8/2014 Kim
2021/0295781 A1* 9/2021 Kim ..... G09G 3/3275

FOREIGN PATENT DOCUMENTS

| | | | |
|---|---|---|---|
| CN | 1971352 | A | 5/2007 |
| CN | 102609132 | A | 7/2012 |
| CN | 207586896 | U | 7/2018 |
| CN | 112214137 | A | 1/2021 |
| CN | 113485048 | A | 10/2021 |

OTHER PUBLICATIONS

Chinese Office Action issued in corresponding Chinese Patent Application No. 202210678068.X dated Aug. 12, 2023, pp. 1-12.

* cited by examiner

*Primary Examiner* — Christopher J Kohlman

(57) ABSTRACT

A display device, a display control method, and an electronic equipment are provided. The display device includes a display panel, a driving module, a time schedule controller, a collection circuit, and a control module. The control module obtains initial collection data provided by sensing units, determines crosstalk extent on the initial collection data, and synchronously compensates the initial collection data according to the crosstalk extent. Induced charges corresponding to target collection data are reduced, or interference to data signals is prevented.

14 Claims, 5 Drawing Sheets

| regional Gain coefficient | | X | | | | | | |
|---|---|---|---|---|---|---|---|---|
| | | 0 | 640 | 1280 | 1920 | 2560 | 3200 | 3840 |
| Y | 0 | | | | | | | |
| | 360 | | | | | | | |
| | 720 | | | | | | | |
| | 1080 | | | | | | | |
| | 1440 | | | | | | | |
| | 1800 | | | | | | | |
| | 2160 | | | | | | | |

| GraytoVoltage_LUT | | |
|---|---|---|
| Pol | Gray | Voltage |
| Positive | 255 | 960 |
| | 224 | 902 |
| | 192 | 848 |
| | 160 | 797 |
| | 128 | 749 |
| | 96 | 704 |
| | 64 | 662 |
| | 32 | 622 |
| | 0 | 600 |
| Negative | 0 | 500 |
| | 32 | 478 |
| | 64 | 438 |
| | 96 | 396 |
| | 128 | 351 |
| | 160 | 303 |
| | 192 | 252 |
| | 224 | 198 |
| | 255 | 140 |

FIG. 6

DISPLAY DEVICE, DISPLAY CONTROL METHOD, AND ELECTRONIC EQUIPMENT

BACKGROUND OF INVENTION

Field of Invention

The present application relates to the field of display technology, and particularly to a display device, a display control method, and an electronic equipment.

Description of Prior Art

The sensing technology in display screens is to realize recognition of light, temperature, and pressure in a pixel level, a high density, and high accuracy in the screens by adding corresponding sensing units in thin-film transistor arrays of the display screens. Therefore, functions such as laser recognition, short-range infrared light intensity judgment, ambient light detection, temperature recognition, and pressure recognition can be realized. These functions can be widely used in fields such as home entertainment, commercial display, educational display, conference interaction, etc.

However, sub-pixels and sensing units in the display screens share corresponding scan lines and common electrodes, and the scan lines synchronously control display data lines to charge the sub-pixels and control sensing data lines to obtain an amount of induced charges in the sensing units. During this process, as voltage variation of the display data lines can affect voltage variation of the common electrodes, the obtained an amount of induced charges is therefore affected, resulting in the obtained amount of induced charges being influenced and reducing accuracy.

SUMMARY OF INVENTION

A display device, a display control method, and an electronic equipment are provided by the present application to ease the technical problem of the low accuracy of the induced charge provided by the sensing units.

On a first aspect, the present application provides a display device. The display device includes a display panel, a driving module, a time schedule controller, a collection circuit, and a control module. The display panel includes sub-pixels, sensing units, common electrodes, display data lines, scan lines, and sensing data lines. The sub-pixels are connected to the corresponding display data lines, scan lines, and common electrodes. The sensing units are connected to the corresponding sensing data lines, scan lines, and common electrodes. The display data lines are configured to transmit data signals. The sensing data lines are configured to transmit initial collection data. Output terminals of the driving module are connected to the display data lines and the scan lines. The time schedule controller is connected to an input terminal of the driving module. The collection circuit is connected to the sensing data lines. The control module is connected to the time schedule controller and the collection circuit and is configured to synchronously compensate the initial collection data according to crosstalk extent of the data signals to the initial collection data to output corresponding target collection data.

In some embodiments, the control module includes a storage unit, and the storage unit is configured to cache data corresponding to the crosstalk extent to align the data corresponding to the crosstalk extent and the initial collection data in time.

On a second aspect, the present application provides a display control method. The display control method includes: electrically connecting sub-pixels to display data lines, scan lines, and common electrodes that are corresponding to the sub-pixels; electrically connecting sensing units to sensing data lines, the scan lines, and the common electrodes that are corresponding to the sensing units, wherein the display data lines are configured to transmit data signals, and the sensing data lines are configured to transmit initial collection data; electrically connecting output terminals of a driving module to the display data lines and the scan lines; electrically connecting a time schedule controller to an input terminal of the driving module; electrically connecting a collection circuit to the sensing data line; electrically connecting a control module to the time schedule controller and the collection circuit; and configuring the control module to synchronously compensate the initial collection data according to crosstalk extent of the data signals to the initial collection data to output corresponding target collection data.

In some embodiments, the display control method further includes: determining a sensing correction amplitude corresponding to the sensing units of each column in a current row according to a data voltage variation amplitude of a previous row, a data voltage variation amplitude of the current row, and an influence factor set; obtaining an initial collection value corresponding to the sensing units of each column in the current row according to the initial collection data; and determining target collection values corresponding to the sensing units in different columns in the current row according to superposition results of sensing correction amplitudes and initial correction values corresponding to the sensing units of each column in the current row, wherein the target collection values are configured to be included in the target collection data.

In some embodiments, the display control method further includes: configuring the influence factor set to comprise a capacitive coupling influence coefficient; and determining a product of the data voltage variation amplitude of the current row and the capacitive coupling influence coefficient as a voltage influence amplitude of the current row, wherein the capacitive coupling influence coefficient is an influence coefficient of voltage variation of the display data lines to a voltage of the common electrodes.

In some embodiments, the display control method further includes: configuring a range of the capacitive coupling influence coefficient to be greater than or equal to 0 and less than or equal to 2.

In some embodiments, the display control method further includes: configuring the influence factor set to include a row attenuation coefficient; determining a product of the data voltage variation amplitude of the current row and the row attenuation coefficient as a voltage variation amplitude of the common electrodes of a current row, wherein the row attenuation coefficient is an influence coefficient of a corresponding row data voltage variation amplitude to a voltage of the common electrodes.

In some embodiments, the display control method further includes: configuring a range of the row attenuation coefficient to be greater than or equal to 0 and less than or equal to 1.

In some embodiments, the display control method further includes: configuring the influence factor set to comprise a location influence coefficient; and determining a superposition result of a voltage variation amplitude of the common electrodes of a previous row and the voltage variation amplitude of the common electrodes of the current row, and then multiplying the superposition result by the location influence coefficient to obtain a product, wherein the product is a voltage coupling amplitude of the common electrodes of the current row, wherein the location influence coefficient is related to positions of the sensing units in the display panel.

In some embodiments, the display control method further includes: configuring a range of the location influence coefficient to be greater than or equal to 0 and less than or equal to 2.

In some embodiments, the display control method further includes: configuring the influence factor set to comprise a sensing coupling influence coefficient; and determining a product of the voltage coupling amplitude of the common electrodes of the current row and the sensing coupling influence coefficient as the sensing correction amplitude corresponding to the sensing units of each column in the current row, wherein the sensing coupling influence coefficient is an influence coefficient of the common electrodes coupling on the initial collection data.

In some embodiments, the display control method further includes: configuring a range of the sensing coupling influence coefficient to be greater than or equal to 0 and less than or equal to 2.

In some embodiments, the display control method further includes: obtaining a grayscale table corresponding to each frame of images according to accessed video data; converting grayscale values in the grayscale table into actual driving voltages of corresponding display data lines according to a mapping table of grayscales and voltages; superimposing each actual driving voltage received by each of the sub-pixels in a same row according to the actual driving voltages of the corresponding display data lines to obtain a total data voltage of a corresponding row; determining a difference between a total data voltage of a previous row and a total data voltage of a row before the previous row as a data voltage variation amplitude of the previous row; determining a difference between a total data voltage of a current row and the total data voltage of the previous row as a data voltage variation amplitude of the current row.

On a third aspect, the present application provides an electronic equipment. The electronic device includes the display device in at least one the aforesaid embodiments. Wherein, the sensing units include at least one of a photosensitive sensor, a temperature sensor, or a pressure-sensitive sensor.

In the display device, the display control method, and the electronic equipment provided by the present application, by sequentially connecting the control module, the collection circuit, the sensing data lines, and the sensing units, the control module can obtain the initial collection data, i.e., the amount of induced charges, provided by the sensing units. At the same time, the control module can extract the corresponding data signal according to the received video data, then determines the crosstalk extent of the data signals to the initially collection data, and then synchronously compensates the initial collection data according to the crosstalk extent to obtain the target collection data corresponding to the initial collection data. In this procedure, because the control module has synchronously compensated the initial collection data according to the crosstalk extent, the amount of the induced charges corresponding to the target collection data is reduced, or the interference of the data signals is prevented, i.e., the amount of the induced charges corresponding to the target collection data is more approximate to an amount of induced charges not being influenced.

DESCRIPTION OF DRAWINGS

The technical solutions and other advantageous effects of the present application will be apparent with reference to the following accompanying drawings and detailed description of embodiments of the present application.

FIG. 6 is a mapping table of grayscales and voltages provided by one embodiment of the present application.

DETAILED DESCRIPTION OF EMBODIMENTS

The technical solutions in the embodiments of the present application are clearly and completely described in the following with reference to the accompanying drawings in the embodiments of the present application. Obviously, the described embodiments are only part of the embodiments of the present application, but are not all embodiments of the present application. All other embodiments obtained by those skilled in the art based on the embodiments of the present application without creative efforts are within the scope of the present application.

Figure 1:
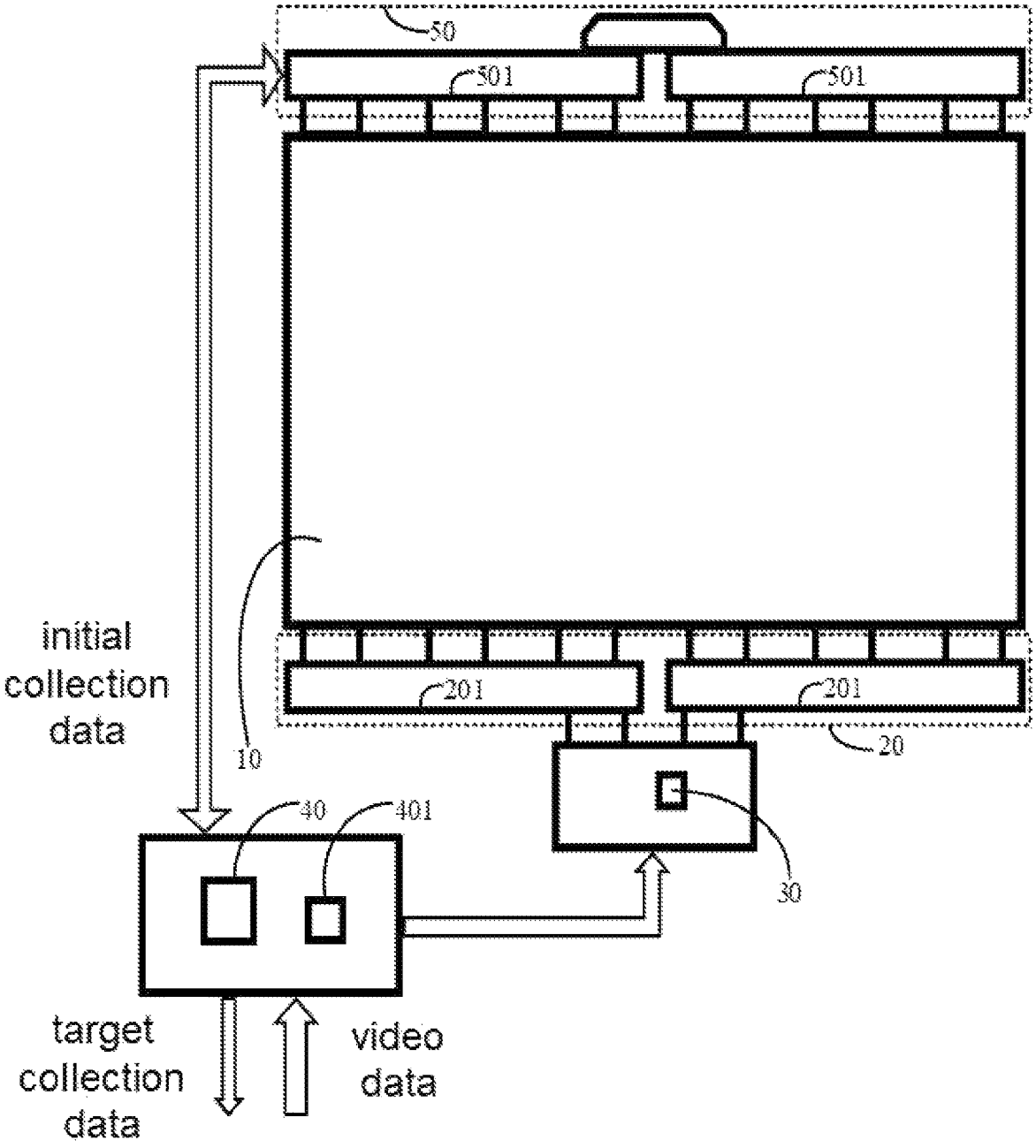
FIG. 1 is a structural schematic diagram of a display device provided by one embodiment of the present application.

In view of the aforesaid technical problem of low accuracy of the induced charges provided by the sensing unit 101, this present embodiment provides a display device. Please refer to FIG. 1 to FIG. 7. As illustrated in FIG. 1, the display device includes a display panel 10, a driving module 20, a time schedule controller 30, a collection circuit 50, and a control module 40. The control module 40 is connected to the time schedule controller 30 and the collection circuit 50. The time schedule controller 30 is connected to of the driving module 20. The display panel 10 is connected to the driving module 20 and the collection circuit 50.

Wherein, the driving module 20 can include one or a plurality of driving modules 201 and is configured to provide corresponding scan signals and data signals to the display panel 10. Each driving unit 201 can be presented in a form of a chip, which can reduce a space occupied by a bezel. It should be noted that functions of a gate driving circuit and a data driver in the related art are integrated in one piece in the driving module 20, e.g., integrated in a same chip, which can further reduce the space occupied by the bezel.

Wherein the time schedule controller 30 is configured to control a time sequence of display an scan. Driving signals provided by the time schedule controller 30 to the driving module 20 usually includes an initial signal SW, a certain number of clock signals CK, and others such as a reset signal RST, a low frequency control signal LC, an enable signal OE, etc. These drive signals are sent from the time schedule controller 30 to a boost circuit and then to an in-plane gate-on-array (GOA) circuit or a gate driving circuit. In this embodiment, these driving signals also need to be provided to the control module 40 at the same time, so that the control module 40 can obtain the corresponding scan time sequence.

The collection circuit 50 can include one or a plurality of analog-to-digital converter 501 and is configured to converts various analog signals provided by the display panel 10 into corresponding data signals to match usage of the control module 40.

Wherein, various initial collection data provided by the display panel 10 are output to the control module 40 through the collection circuit 50, and the control module 40 synchronously compensates the initial collection data according to crosstalk extent of the data signals to the initial collection data to output corresponding target collection data.

It can be understood that in the display device provided by this embodiment, by sequentially connecting the control module 40, the collection circuit 50, the sensing data lines 102, and the sensing units 101, the control module 40 can obtain the initial collection data. i.e., the amount of induced charges, provided by the sensing units 101. At the same time, the control module 40 can extract the corresponding data signal according to the received video data, then determines the crosstalk extent of the data signals to the initially collection data, and then synchronously compensates the initial collection data according to the crosstalk extent to obtain the target collection data corresponding to the initial collection data. In this procedure, because the control module 40 has synchronously compensated the initial collection data according to the crosstalk extent, the amount of the induced charges corresponding to the target collection data is reduced, or the interference of the data signals is prevented, i.e., the amount of the induced charges corresponding to the target collection data is more approximate to an amount of induced charges not being influenced.

In one of the embodiments, the control module 40 includes a storage unit 401, and the storage unit 401 is configured to cache data corresponding to the crosstalk extent to align the data corresponding to the crosstalk extent and the initial collection data in time.

It should be noted that because the times of the video data inputted to the control module 40 and the initial collection signal outputted to the control module 40 being transmitted to the control module 40 has a certain difference, the storage unit 401 needs to cache the data corresponding to the crosstalk extent, so as to realize the two to be synchronized in time, thereby realizing synchronization for compensating of the initial collection data.

Figure 2:
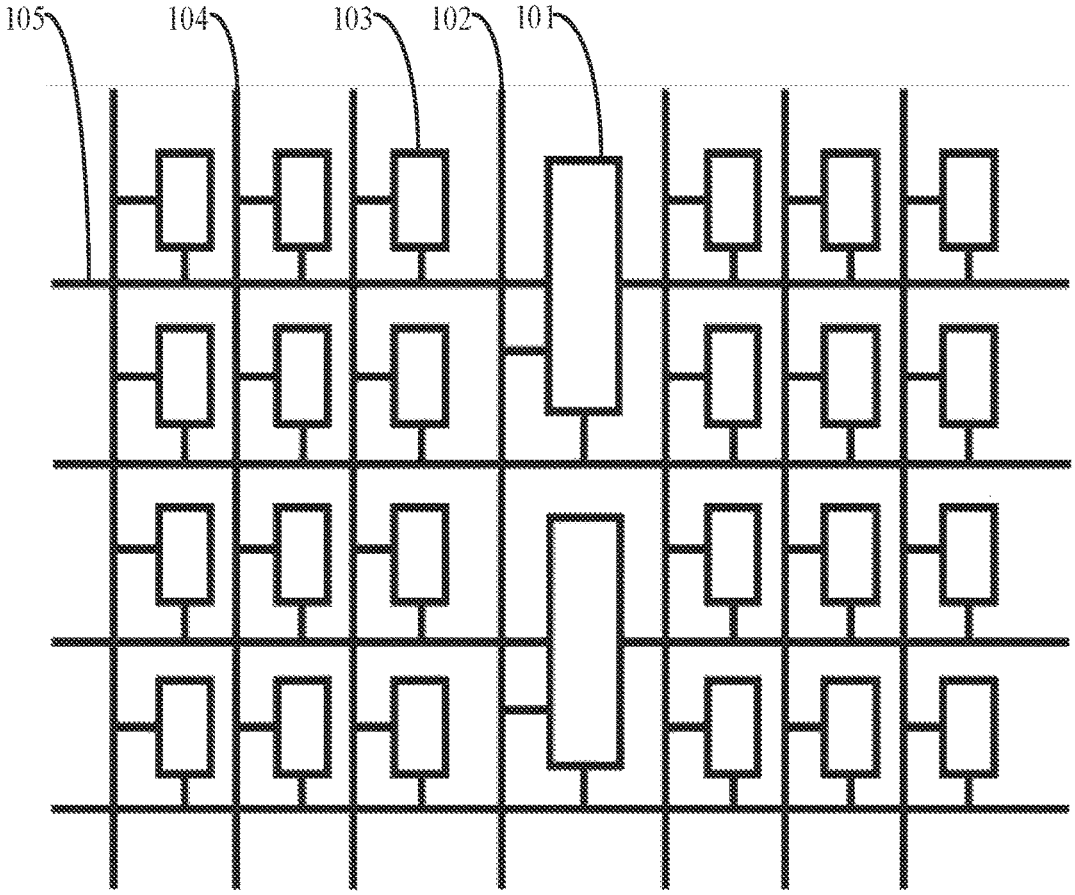
FIG. 2 is a structural schematic diagram of a display panel provided by one embodiment of the present application.

In one of the embodiments, as illustrated in FIG. 2, the display panel 10 includes sub-pixels 103, sensing units 101, display data lines 104, scan lines 105, and sensing data lines 102. The sub-pixels 103 are connected to the corresponding display data lines 104 and the scan lines 105. The sensing units 101 are connected to the corresponding sensing data lines 102 and the scan lines 105. The display data lines 104 are configured to transmit data signals. The sensing data lines 102 are configured to transmit initial collection data. Output terminals of the driving module 20 are connected to the display data lines 104 and the scan lines 105. The time schedule controller 30 is connected to an input terminal of the driving module 20. The collection circuit 50 is connected to the sensing data lines 102. The control module 40 is connected to the time schedule controller 30 and the collection circuit 50. The scan signal in the scan line 105 can synchronously control the sub-pixels 103 to write the corresponding data signals, and the sensing units 101 to output the corresponding initial collection data.

Wherein, each of the sub-pixels 103 is distributed in an array manner, and each of the sensing units 101 can also be distributed in an array manner. One or a plurality of sensing unit columns can be arranged between two adjacent sub-pixel columns, or one or the plurality of sensing unit columns can be disposed between two adjacent sub-pixel rows, or one sensing unit column is arranged by every one or the plurality of sub-pixel columns. Furthermore, one sensing unit row can occupy a space of one or the plurality of sub-pixel rows as illustrated in FIG. 2. It should be noted that the sub-pixels 103 and the sensing units 101 connected to a same scan line can form a same row, e.g., a previous row, a current row, etc. mentioned below.

Figure 3:
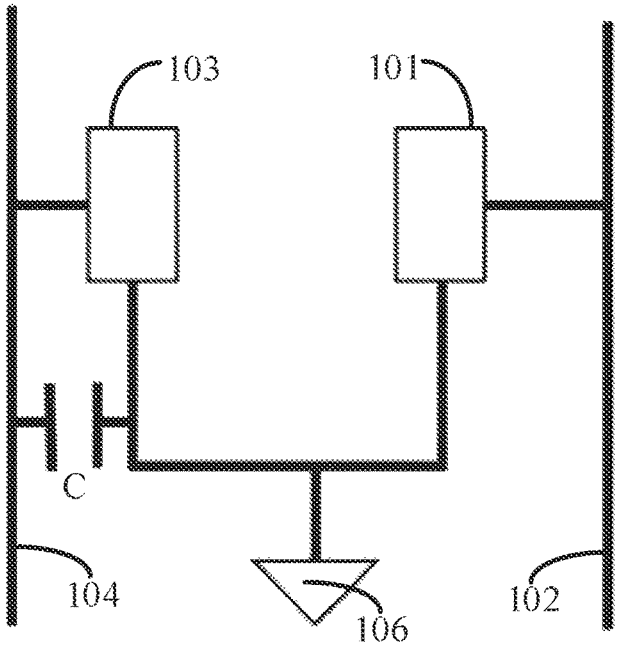
FIG. 3 is an equivalent circuit diagram of the display panel provided by one embodiment of the present application.

In one of the embodiments, as illustrated in FIG. 3, the display panel 10 further includes common electrodes 106. The common electrodes 106 are connected to corresponding sub-pixels 103 and sensing units 101. Because different data lines/display data lines 104 form coupling capacitors C between the corresponding common electrodes 106, when an electric potential of the data signals in the data lines changes, an electric potential of the common electrode 106 can be affected. Furthermore, variation of the electric potential of the common electrode 106 can also affect the initial collection data, causing the initial collection data to be influenced and distorted.

Figures 4, 5:
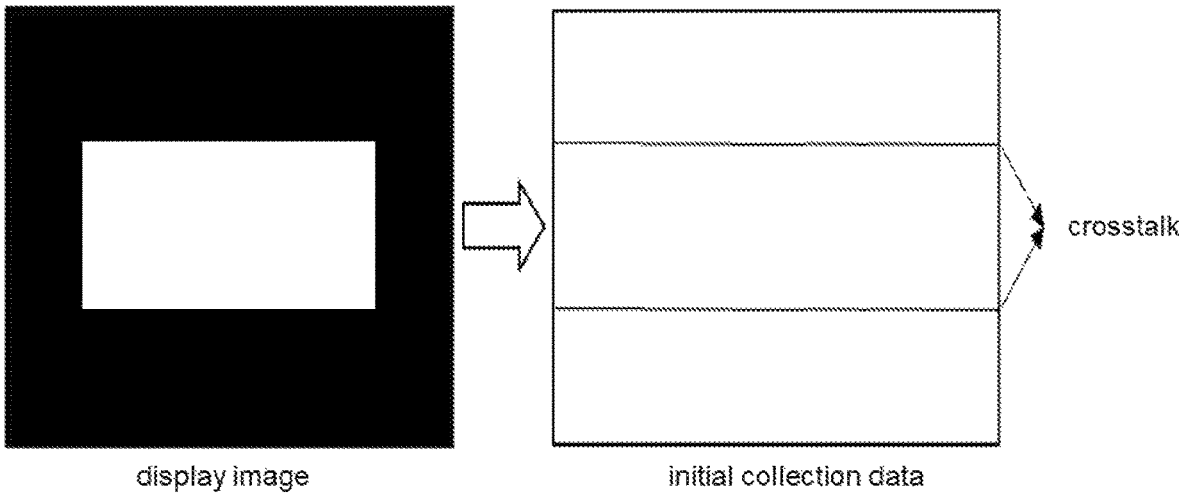
FIG. 4 is a structural schematic diagram of a crosstalk phenomenon provided by one embodiment of the present application.
FIG. 5 is a structural schematic diagram of location influence coefficients provided by one embodiment of the present application.

The situation of the aforesaid distortion leads to the situation illustrated in FIG. 4. A display image illustrated on the left in FIG. 4 is a black background with a white frame at center. In the white frame, a first row is fully white display, and a line above the first row is fully black display. The display data lines 104 in the white frame need to change from fully black display to fully white display when the first row is charged. Therefore, the voltage of the data signal needs to have a large variation. In this situation, due to existence of the coupling capacitor C in FIG. 3, the voltage of the common electrodes 106 can also be changed due to the coupling, which can affect the sensing units 101 currently sampling in the same row, resulting in the initial collection data of the entire row being low at the corresponding position.

Similarly, it can be understood that the display data lines 104 in the white frame need to change from fully white display to fully black display when the last row is charged. Therefore, the voltage of the data signal needs to have a large variation. In this situation, due to existence of the coupling capacitor C in FIG. 3, the voltage of the common electrodes 106 can also be changed due to the coupling, which can affect the sensing units 101 currently sampling in the same row, resulting in the initial collection data of the entire row being high at the corresponding position.

In one of the embodiments, the control module 40 determines a sensing correction amplitude corresponding to the sensing units 101 of each column in a current row according to a data voltage variation amplitude of a previous row, a data voltage variation amplitude of the current row, and an influence factor set; the control module 40 obtains an initial collection value corresponding to the sensing units 101 of each column in the current row according to the initial collection data; the control module 40 determines target collection values corresponding to the sensing units 101 in different columns in the current row according to superposition results of sensing correction amplitudes and initial correction values corresponding to the sensing units 101 of each column in the current row; and the target collection values are configured to be included in the target collection data.

It should be noted that the data voltage variation amplitude in the previous row refers to the result of subjecting the sum of the voltages of each data signal transmitted to each sub-pixels 10 in the row before the previous row from the sum of the voltages of each data signal transmitted to each sub-pixel 103 in the previous row. Similarly, the data voltage variation amplitude in the current row refers to the result of subjecting the sum of the voltages of each data signal transmitted to each sub-pixel 103 in the previous row from the sum of the voltages of each data signal transmitted to each sub-pixel 103 in the current row. Wherein, if the previous row is the first row, the sum of the voltages of each data signals transmitted to each sub-pixel 103 in the row before the previous row can be configured as a preset value, and the preset value can be obtained according to experience or a plurality of experiments.

Wherein, each sensing unit 101 can include a sensing element and a storage capacitor connected to each other. The storage capacitor is configured to store the sensed charges or the initial collection data. The influence factor set can include one or a plurality of sensing coupling influence coefficients, and each of the influence coefficients can contribute more or less to the compensation accuracy of the initial collection data.

In one of the embodiments, the influence factor set includes a capacitive coupling influence coefficient, and the control module 40 determines a product of the data voltage variation amplitude of the current row and the capacitive coupling influence coefficient as a voltage influence amplitude of the current row. Wherein, the capacitive coupling influence coefficient is an influence coefficient of voltage variation of the display data lines 104 to a voltage of the common electrodes 106.

It should be noted that a size of the aforesaid capacitive coupling influence coefficient is determined by the capacitance of the coupling capacitor C illustrated in FIG. 3.

In one of the embodiments, a range of the capacitive coupling influence coefficient is greater than or equal to 0 and less than or equal to 2.

It can be understood that the value of the capacitive coupling influence coefficient in this embodiment can also be any one of 0.1, 0.2, 0.3, 0.4, 0.5, 0.6, 0.7, 0.8, 0.9, 1.1, 1.2, 1.3, 1.4, 1.5, 1.6, 1.7, 1.8 or 1.9, etc., specifically. It can be understood that the capacitive coupling influence coefficient can be either increased or decreased according to the data voltage variation amplitude of the current row, which has high flexibility.

In one of the embodiments, the influence factor set include a row attenuation coefficient, and the control module 40 determines a product of the data voltage variation amplitude of the current row and the row attenuation coefficient as a voltage variation amplitude of the common electrodes of a current row. Wherein, the row attenuation coefficient is an influence coefficient of a corresponding row data voltage variation amplitude to a voltage of the common electrodes 106.

It should be noted that in this embodiment, as other rows are farther and farther away from the common electrodes 106 in the current row, the coupling extent of the data voltage variation of other rows to the common electrode 106 becomes smaller and smaller, and correspondingly, the row attenuation coefficient is also smaller and smaller; otherwise, the row attenuation coefficient is getting larger and larger. For example, in a process of calculating the voltage variation range of the common electrode in a fifth row, as a distance from the first row to the fifth row is greater than a distance from the second row to the fifth row, the coupling extent of the data voltage variation range of the first row to the common electrode 106 is lower than the coupling extent of the data voltage variation range of the second row to the common electrode 106, and the row attenuation coefficient corresponding to the data voltage variation range of the first row is less than the row attenuation coefficient corresponding to the data voltage variation range of the second row.

It can be understood that as the coupling extents of different data lines to a same common electrode 106 being different is further considered in this embodiment, the interference extent of the initially collection data is also different, so that the accuracy of compensation is further improved.

In one of the embodiments, a range of the row attenuation coefficient is greater than or equal to 0 and less than or equal to 1.

It should be noted that in this embodiment, the value of the capacitive coupling influence coefficient can also be any one of 0.1, 0.2, 0.3, 0.4, 0.5, 0.6, 0.7, 0.8, 0.9, etc., specifically.

In one of the embodiments, the influence factor set includes a location influence coefficient, and the control module 40 determines a superposition result of a voltage variation amplitude of the common electrodes of a previous row and the voltage variation amplitude of the common electrodes of the current row, and then multiplies the superposition result by the location influence coefficient to obtain a product, wherein the product is a voltage coupling amplitude of the common electrodes of the current row. Wherein, the location influence coefficient is related to positions of the sensing units 101 in the display panel 10.

It should be noted that, the aforesaid location influence coefficient (regional Gain coefficient) can be determined according to the table shown in FIG. 5. For example, at first the location influence coefficients corresponding to some binding point coordinates (X, Y) can be configured in the display panel 10 first; and for coordinates between these binding point coordinates or the location influence coefficient corresponding to the region, bilinear interpolation can be adopted to calculate the location influence coefficients of the corresponding locations. Wherein, a value of X can be a number of rows of the sub-pixels 103, such as 0, 640, 1280, 1920, 3200, 3840, etc., and a value of Y can be a number of columns of the sub-pixels 103, such as 0, 360, 720, 1080, 1440, 1800, 2160, etc. Then, the location influence coefficient corresponding to the sensing units 101 is determined according to position of the sensing unit 101 in the display panel 10 and which coordinate is closer.

It can be understood that as the interference of the positions of the sensing units 101 in the display panel 10 to the initially collection data is further considered in the present application, the accuracy of the compensation is further improved.

In one of the embodiments, a range of the location influence coefficient is greater than or equal to 0 and less than or equal to 2.

It should be noted that a value of the location influence coefficient in this embodiment can be any one of 0.1, 0.2, 0.3, 0.4, 0.5, 0.6, 0.7, 0.8, 0.9, 1.1, 1.2, 1.3, 1.4, 1.5, 1.6, 1.7, 1.8, or 1.9, etc., specifically. It can be understood that the location influence coefficient can be either increased or decreased according to the superposition result of the voltage variation amplitude of the common electrodes of the previous row and the voltage variation amplitude of the common electrodes of the current row, which has high flexibility.

In one of the embodiments, the influence factor set includes a sensing coupling influence coefficient, and the control module 40 determines a product of the voltage coupling amplitude of the common electrodes of the current row and the sensing coupling influence coefficient as the sensing correction amplitude corresponding to the sensing units 101 of each column in the current row. Wherein, the sensing coupling influence coefficient is an influence coefficient of the common electrodes coupling on the initial collection data.

It should be noted that the sensing coupling influence coefficient can be obtained according to experience or a plurality of experiments, and the value of the sensing coupling influence coefficient is not specifically limited herein.

It can be understood that as the interference of the common electrodes coupling on the initial collection data is further considered in the present application, the accuracy of the compensation is further improved.

In one of the embodiments, a range of the sensing coupling influence coefficient is greater than or equal to 0 and less than or equal to 2.

It can be understood that the value of the sensing coupling influence coefficient in this embodiment can also be any one of 0.1, 0.2, 0.3, 0.4, 0.5, 0.6, 0.7, 0.8, 0.9, 1.1, 1.2, 1.3, 1.4, 1.5, 1.6, 1.7, 1.8 or 1.9, etc., specifically. It can be understood that the sensing coupling influence coefficient can be either increased or decreased according to the voltage coupling amplitude of the common electrodes of the current row, which has high flexibility.

In one of the embodiments, the control module 40 obtains a grayscale table corresponding to each frame of images according to accessed video data, converts grayscale values in the grayscale table into actual driving voltages of corresponding display data lines 104 according to a mapping table of grayscales and voltages, and superimposes each actual driving voltage received by each of the sub-pixels 103 in a same row according to the actual driving voltages of the corresponding display data lines 104 to obtain a total data voltage of a corresponding row; the control module 40 determines a difference between a total data voltage of a previous row and a total data voltage of a row before the previous row as a data voltage variation amplitude of the previous row; and the control module 40 determines a difference between a total data voltage of a current row and a total data voltage of the previous row as a data voltage variation amplitude of the current row.

It should be noted that the mapping table of the grayscales and the voltages (GraytoVoltage_LUT) in this embodiment is illustrated in FIG. 6, and a pixel polarity (Pol) is configured to distinguish whether the actual driving voltage is positive or negative. Taking a total number of 1024 grayscale binding points as an example, in a situation that the pixel polarity is positive, the grayscale 255 is converted into the actual driving voltage corresponding to the grayscale binding point 960, the grayscale 224 is converted into the actual driving voltage corresponding to the grayscale binding point 902, the grayscale 192 is converted into the actual driving voltage corresponding to the grayscale binding point 848, the grayscale 160 is converted into the actual driving voltage corresponding to the grayscale binding point 797, the grayscale 128 is converted into the actual driving voltage corresponding to the grayscale binding point 749, the grayscale 96 is converted into the actual driving voltage corresponding to the grayscale binding point 704, the grayscale 64 is converted into the actual driving voltage corresponding to the grayscale binding point 662, the grayscale 32 is converted into the actual driving voltage corresponding to the grayscale binding point 622, and the grayscale 0 is converted into the actual driving voltage corresponding to the grayscale binding point 600; and in a situation that the pixel polarity is negative, the grayscale 0 is converted into the actual driving voltage corresponding to the grayscale binding point 500, the grayscale 32 is converted into the actual driving voltage corresponding to the grayscale binding point 478, the grayscale 64 is converted into the actual driving voltage corresponding to the grayscale binding point 438, the grayscale 96 is converted into the actual driving voltage corresponding to the grayscale binding point 396, the grayscale 128 is converted into the actual driving voltage corresponding to the grayscale binding point 351, the grayscale 160 is converted into the actual driving voltage corresponding to the grayscale binding point 303, the grayscale 192 is converted into the actual driving voltage corresponding to the grayscale binding point 252, the grayscale 224 is converted into the actual driving voltage corresponding to the grayscale binding point 198, and the grayscale 255 is converted into the actual driving voltage corresponding to the grayscale binding point 140.

In summary, by repeating one or a plurality of the aforesaid embodiments, the sensing correction amplitude corresponding to each row can be obtained, and finally the sensing correction amplitude corresponding to one frame can be obtained. Therefore, the synchronous compensation of the initially collection data can be realized in each frame of the images.

In one of the embodiments, the sensing units 101 include at least one of a photosensitive sensor, a temperature sensor, or a pressure-sensitive sensor. It should be noted that these photosensitive sensor, temperature sensor, and pressure-sensitive sensor can all be manufactured as semiconductor structures in thin-film transistor arrays to achieve pixel-level high-density sensing.

Figure 7:
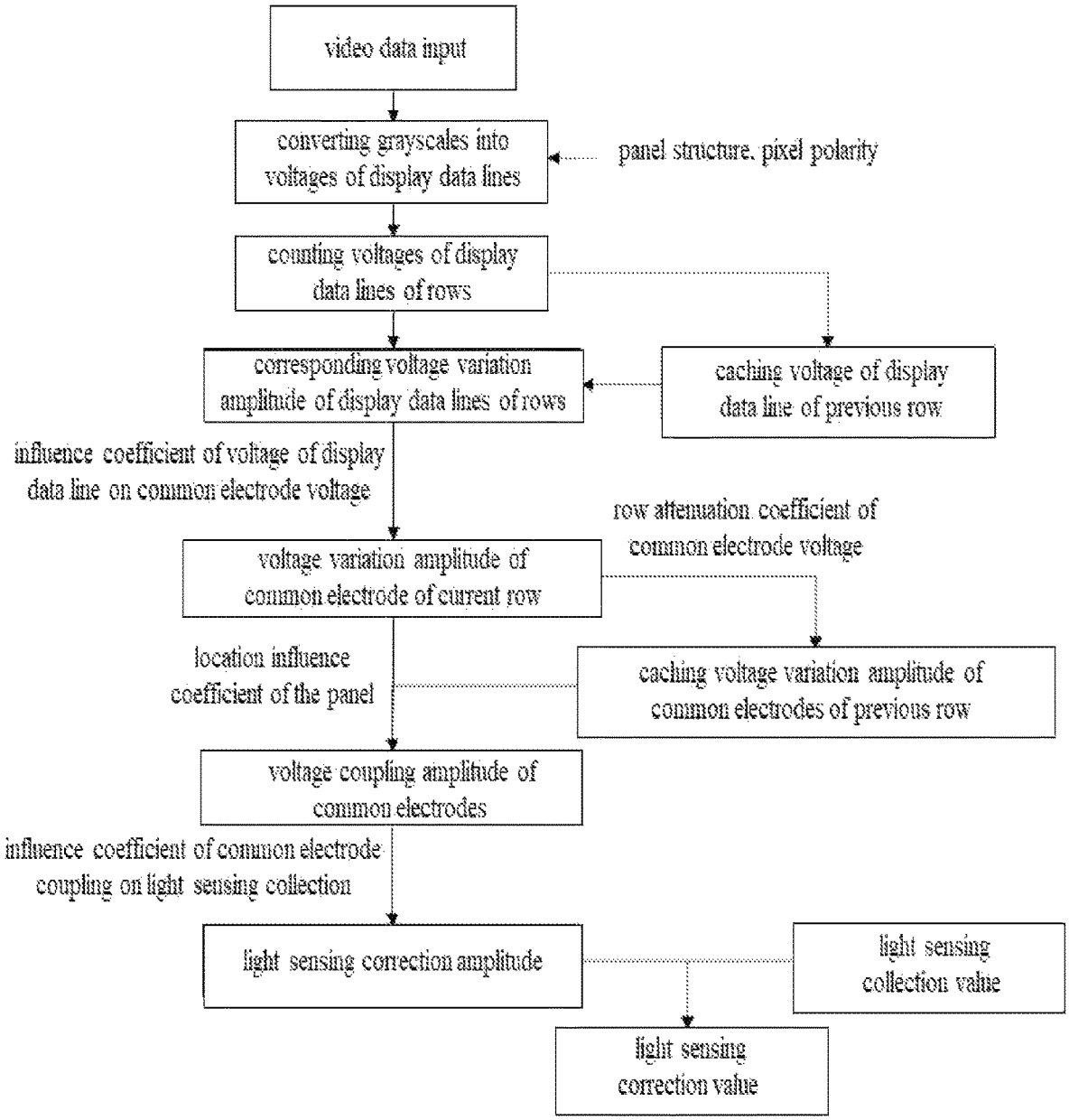
FIG. 7 is a flowchart of synchronous compensation provided by one embodiment of the present application.

In one of the embodiments, an aforesaid synchronization compensation process for the initial collection data is described by taking light sensing as an example. As illustrated in FIG. 7, firstly, video data are inputted, and the corresponding grayscales are obtained according to the video data. Then, the grayscales are converted into voltages of the corresponding display data lines 104 according to the panel structure and pixel polarity. Then, the voltages of the display data line 104 of rows are counted, and the voltage of the display data line 104 of the previous row is cached to calculate the voltage variation range of the display data line 104 of the corresponding row, and then the influence coefficient of the voltage of the display data line 104 on the common electrode voltage is multiplied to obtain the voltage variation amplitude of the common electrode of the current row. The voltage variation amplitude of the common electrode of the current row is multiplied by the row attenuation coefficient of the common electrode voltage to obtain the voltage variation amplitude of the common electrodes of the previous row and is cached. The voltage variation amplitude of the common electrode of the current row is multiplied by the location influence coefficient of the panel to obtain the voltage coupling amplitude of the common electrodes. The voltage coupling amplitude of the common electrodes is multiplied by the influence coefficient of the common electrode coupling on light sensing collection to obtain a light sensing correction amplitude. The light sensing correction amplitude is superposed a light sensing collection value to obtain a light sensing correction value. The light sensing correction value is the target collection value, and the plurality of target collection values can compose the target collection data.

It can be understood that the light sensing in the synchronous compensation illustrated in FIG. 7 can also be replaced with other analog sensing such as pressure sensing or temperature sensing.

In one of the embodiments, this embodiment provides an electronic equipment. The electronic equipment includes the display device in at least one the aforesaid embodiments.

It can be understood that in the electronic equipment provided by this embodiment, by sequentially connecting the control module 40, the collection circuit 50, the sensing data lines 102, and the sensing units 101, the control module 40 can obtain the initial collection data. i.e., the amount of induced charges, provided by the sensing units 101. At the same time, the control module 40 can extract the corresponding data signal according to the received video data, then determines the crosstalk extent of the data signals to the initially collection data, and then synchronously compensates the initial collection data according to the crosstalk extent to obtain the target collection data corresponding to the initial collection data. In this procedure, because the control module 40 has synchronously compensated the initial collection data according to the crosstalk extent, the amount of the induced charges corresponding to the target collection data is reduced, or the interference of the data signals is prevented, i.e., the amount of the induced charges corresponding to the target collection data is more approximate to an amount of induced charges not being influenced.

Wherein, the aforesaid display device, which acts as a device for displaying video or still images, can be not only fixed terminals such as a televisions, a desktop computer, a monitor, a billboard; but also can be a mobile terminal such as a mobile phone, a tablet computer, a mobile communication terminal, an electronic notepad, an electronic book, a multimedia player, a navigator, a laptops, and also can be a wearable electronic device such as a smart watch, a smart glass, a virtual reality device, an augmented reality device.

The aforesaid display device is not limited to a certain type, for example, it can be a liquid crystal display device or other active light-emitting type display device. It can be understood that as long as these display devices can adapt to the conditions described in the aforesaid embodiments, the corresponding technical effects of the present application can be achieved.

In the aforesaid embodiments, the descriptions to the various embodiments are emphasized, and the part is not described in detailed in one embodiment, can refer to the detailed description of other aforesaid embodiments.

The display device, the display control method, and the electronic equipment provided by embodiments of present application are described in detail above. This article uses specific cases for describing the principles and the embodiments of the present application, and the description of the embodiments mentioned above is only for helping to understand the method and the core idea of the present application. It should be understood by those skilled in the art, that it can perform changes in the technical solution of the embodiments mentioned above, or can perform equivalent replacements in part of technical characteristics, and the changes or replacements do not make the essence of the corresponding technical solution depart from the scope of the technical solution of each embodiment of the present application.

What is claimed is:

1. A display device, comprising:

a display panel, wherein the display panel comprise:

sub-pixels, sensing units, common electrodes, display data lines, scan lines, and sensing data lines; wherein the sub-pixels are connected to the display data lines, the scan lines, and the common electrodes that are corresponding to the sub-pixels; the sensing units are connected to the sensing data lines, the scan lines, and the common electrodes that are corresponding to the sensing units; the display data lines are configured to transmit data signals, and the sensing data lines are configured to transmit initial collection data;

a driving module, wherein output terminals of the driving module are connected to the display data lines and the scan lines;

a time schedule controller, wherein the time schedule controller is connected to an input terminal of the driving module;

a collection circuit, wherein the collection circuit is connected to the sensing data lines; and a control module, wherein the control module is connected to the time schedule controller and the collection circuit, and is configured to synchronously compensate the initial collection data according to crosstalk extent of the data signals to the initial collection data to output corresponding target collection data.

2. The display device as claimed in claim 1, wherein the control module comprises a storage unit, and the storage unit is configured to cache data corresponding to the crosstalk extent to align the data corresponding to the crosstalk extent and the initial collection data in time.

3. A display control method, comprising:

electrically connecting sub-pixels to display data lines, scan lines, and common electrodes that are corresponding to the sub-pixels;

electrically connecting sensing units to sensing data lines, the scan lines, and the common electrodes that are corresponding to the sensing units, wherein the display data lines are configured to transmit data signals, and the sensing data lines are configured to transmit initial collection data;

electrically connecting output terminals of a driving module to the display data lines and the scan lines;

electrically connecting a time schedule controller to an input terminal of the driving module;

electrically connecting a collection circuit to the sensing data line;

electrically connecting a control module to the time schedule controller and the collection circuit; and configuring the control module to synchronously compensate the initial collection data according to crosstalk extent of the data signals to the initial collection data to output corresponding target collection data.

4. The display control method as claimed in claim 3, comprising:

determining a sensing correction amplitude corresponding to the sensing units of each column in a current row according to a data voltage variation amplitude of a previous row, a data voltage variation amplitude of the current row, and an influence factor set;

obtaining an initial collection value corresponding to the sensing units of each column in the current row according to the initial collection data; and determining target collection values corresponding to the sensing units in different columns in the current row according to superposition results of sensing correction amplitudes and initial correction values corresponding to the sensing units of each column in the current row, wherein the target collection values are configured to be comprised in the target collection data.

5. The display control method as claimed in claim 4, comprising:

configuring the influence factor set to comprise a capacitive coupling influence coefficient; and determining a product of the data voltage variation amplitude of the current row and the capacitive coupling influence coefficient as a voltage influence amplitude of the current row, wherein the capacitive coupling influence coefficient is an influence coefficient of voltage variation of the display data lines to a voltage of the common electrodes.

6. The display control method as claimed in claim 5, comprising:

configuring a range of the capacitive coupling influence coefficient to be greater than or equal to 0 and less than or equal to 2.

7. The display control method as claimed in claim 5, comprising:

configuring the influence factor set to comprise a row attenuation coefficient; and determining a product of the data voltage variation amplitude of the current row and the row attenuation coefficient as a voltage variation amplitude of the common electrodes of a current row, wherein the row attenuation coefficient is an influence coefficient of a corresponding row data voltage variation amplitude to the voltage of the common electrodes.

8. The display control method as claimed in claim 7, comprising:

configuring a range of the row attenuation coefficient to be greater than or equal to 0 and less than or equal to 1.

9. The display control method as claimed in claim 7, comprising:

configuring the influence factor set to comprise a location influence coefficient; and determining a superposition result of a voltage variation amplitude of the common electrodes of a previous row and the voltage variation amplitude of the common electrodes of the current row, and then multiplying the superposition result by the location influence coefficient to obtain a product, wherein the product is a voltage coupling amplitude of the common electrodes of the current row, and wherein the location influence coefficient is related to positions of the sensing units in the display panel.

10. The display control method as claimed in claim 9, comprising:

configuring a range of the location influence coefficient to be greater than or equal to 0 and less than or equal to 2.

11. The display control method as claimed in claim 9, comprising:

configuring the influence factor set to comprise a sensing coupling influence coefficient; and determining a product of the voltage coupling amplitude of the common electrodes of the current row and the sensing coupling influence coefficient as the sensing correction amplitude corresponding to the sensing units of each column in the current row, wherein the sensing coupling influence coefficient is an influence coefficient of the common electrodes coupling on the initial collection data.

12. The display control method as claimed in claim 11, comprising:

configuring a range of the sensing coupling influence coefficient to be greater than or equal to 0 and less than or equal to 2.

13. The display control method as claimed in claim 4, comprising:

obtaining a grayscale table corresponding to each frame of images according to accessed video data;

converting grayscale values in the grayscale table into actual driving voltages of corresponding display data lines according to a mapping table of grayscales and voltages;

superimposing each actual driving voltages received by each of the sub-pixels in a same row according to the actual driving voltages of the corresponding display data lines to obtain a total data voltage of a corresponding row;

determining a difference between a total data voltage of a previous row and a total data voltage of a row before the previous row as a data voltage variation amplitude of the previous row; and determining a difference between a total data voltage of a current row and the total data voltage of the previous row as a data voltage variation amplitude of the current row.

14. An electronic equipment, comprising a display device as claimed in claim 1, wherein the sensing units comprise at least one of a photosensitive sensor, a temperature sensor, or a pressure-sensitive sensor.

* * * * *